United States Patent [19]

Bandar

[11] 4,376,558

[45] Mar. 15, 1983

[54] THERMAL RETENTION CONTAINER

[76] Inventor: Beverly Bandar, 5 Scotts Ct., Scotts Valley, Calif. 95066

[21] Appl. No.: 247,371

[22] Filed: Mar. 25, 1981

[51] Int. Cl.[3] ..... A47B 43/00; B65D 90/04

[52] U.S. Cl. ..... 312/259; 312/214; 312/258; 229/31 FS; 220/400; 220/412; 206/523

[58] Field of Search ..... 312/259, 258, 214, DIG. 33, 312/242; 220/400, 412, 413; 206/523; 229/31 R, 31 FS; 108/38, 42

[56] References Cited

U.S. PATENT DOCUMENTS

| | | | |
|---|---|---|---|
| 2,555,126 | 5/1951 | Greve | 206/523 |
| 2,904,382 | 9/1959 | Mitten | 312/259 |
| 2,979,246 | 4/1961 | Liebeskind | 206/523 |
| 3,472,571 | 10/1969 | Himelreich | 312/259 |
| 3,516,596 | 6/1970 | Madden et al. | 206/499 |
| 3,881,794 | 5/1975 | Henning | 312/259 |
| 4,319,795 | 3/1982 | Klaus | 312/259 |

*Primary Examiner*—Victor N. Sakran

*Attorney, Agent, or Firm*—Burns, Doane, Swecker & Mathis

[57] ABSTRACT

A thermal retention container for edibles, especially pizza, that is durable enough for multiple use but inexpensive of construction so as to permit early disposal is disclosed. The container is characterized by a cardboard outer housing having a pair of flanged closing panels to which housing and panels are internally affixed insulating panels. The container contains a plurality of shelves such as to permit transport and/or storage of a plurality of pizzas or the like.

7 Claims, 5 Drawing Figures

THERMAL RETENTION CONTAINER

BACKGROUND OF THE INVENTION

1. Field of the Invention

This invention relates to a limited-life thermal retention container which is particularly useful for storing or transporting hot or cold food. In a preferred embodiment, the thermal retention container of this invention is adapted to store and/or transport a plurality of pizzas.

2. Background

There is an ever-growing consumption of prepared hot and frozen food products. In both cases it is desirable to insulate the food product during storage or transport to retain its thermal properties. Insulating carriers used heretofore have generally been of one of two possible types--expensive, multi-use containers having a metal double-wall construction filled with fiberglass or other known insulators, and inexpensive single-use disposable consumer containers ranging from simple single-wall pizza boxes to insulated icecream bags to paper-foil laminated bags. The more expensive variety of carriers provide higher thermal retention efficiencies as compared to the aforementioned bags and boxes, but obviously are not economically purchased by or distributed to limited-use consumers. What is needed is an intermediate product—one that approximates the low cost characteristics of the disposable consumer products, but offers a prolonged life and the higher thermal retention properties of the more expensive, multi-use containers.

Accordingly, it is the primary object of my invention to provide a thermal retention container which will have insulating properties approximating those of multi-use permanent containers but having a low cost construction permitting its use as a disposable consumer product.

Another object of my invention is to provide a low cost thermal retention container which is durable enough to permit repeated use.

STATEMENT OF THE INVENTION

In accordance with my invention, a thermal retention container is provided that has a front-opening exterior housing defined by a back wall, opposite top and bottom walls, two opposite side walls and a two-door closable front all fabricated of cardboard.

The term "cardboard" as used herein is intended to encompass corrugated cardboard, paper board and like equivalent paper products. The two closable front doors are hinged to the front edges of two opposite walls and have folded flanges perpendicular to their surface on their remaining three sides. The remaining front edges of the walls of the exterior housing are notched to receive the flanges when the doors are closed. Flat plastic foam inner panels corresponding in size to the inner surfaces of the top, bottom and back walls are attached thereto. Similar panels are attached to the inner surface of the front doors. A plurality of removable cardboard shelves are positioned inside the container. They are held in spaced parallel arrangement by plastic foam spacers located on the inner surfaces of the opposite side walls. These spacers can be separate blocks or they can be integral with additional flat plastic foam panels that are placed on the inner surfaces of the opposite side walls.

The invention and its advantages will be further understood from the description of the preferred embodiment and the accompanying drawing.

DESCRIPTION OF THE PREFERRED EMBODIMENT

Figure 1:
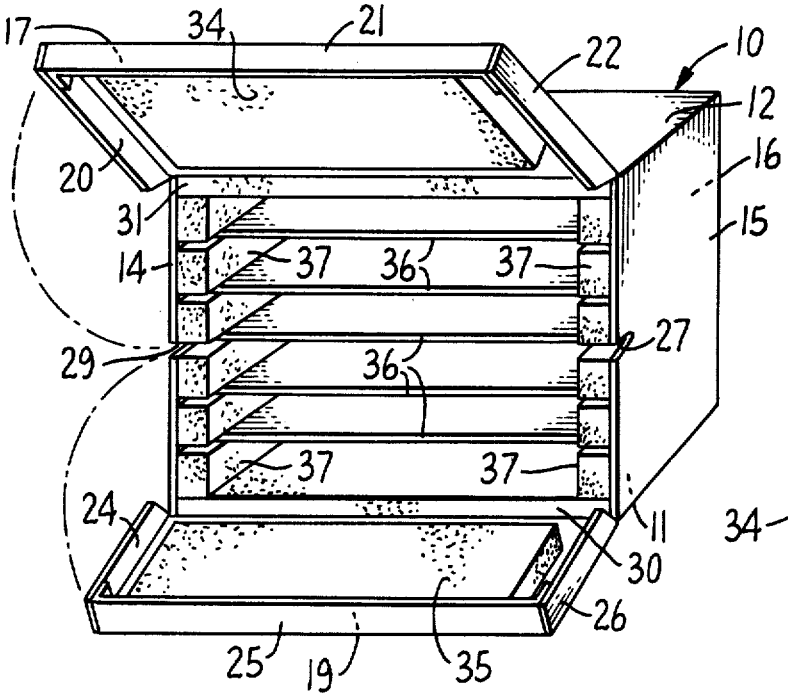
FIG. 1 is an isometric view of a thermal retention container of this invention.

Referring now in detail to the drawing, wherein like reference numerals denote like parts throughout the several Figures, there is shown in FIG. 1 an isometric essentially front view of a thermal retention container of this invention, generally designated 10. Container 10 includes a rectangular open faced outer housing and defined by bottom wall 11, top wall 12, parallel and opposite side walls 14 and 15 and back wall 16. This housing is made of cardboard, preferably singlewall corrugated board having a bursting strength of from about 175 to 300 pounds per square inch. The front opening is covered by moveable front closing panels 17 and 19. These are hinged to a pair of opposite walls, here shown as bottom and top walls 11 and 12. Very suitably, they are merely extensions of the walls with creases providing the desired hinges. Closing panels 17 and 19 have flanges on their remaining edges. These flanges are depicted 20, 21 and 22 on panel 17 and 24, 25 and 26 on panel 19. These flanges are perpendicular to their carrying panels and may be separate and attached or preferably are constructed by suitably folding the edges of panels 17 and 19. These flanges are positioned so that when closing panels 17 and 19 are closed, the flanges butt together in the center and are on the outside of walls 11 and 12 thereby effecting a good seal with walls 11 and 12. Walls 11 and 12 carry notches 27 and 29 respectively to permit closing panels 17 and 19 close tightly. These notches may be cut so as to assist in locking panels 17 and 19 in their closed positions. An additional closure means (not shown) very suitably is provided to lock closing panels 17 and 19 in their closed positions. This can be a tab and slot arrangement, a Velcro joining strip, an adhesive strip or of like simple and inexpensive construction. The bottom of container 10 has a flat sheet of insulation 30. This and the other insulation is plastic foam, preferably low density polyurethane or polystyrene foam such as of a density of from about 0.4 to 2.0 lb/cubic foot. Sheet 30 is of an effective heat retaining thickness—generally from about ½ to 3 inches thick, preferably from about 1 to about 2 inches thick. Insulation sheet 30 is affixed to bottom wall 11 by adhesives. A similar insulation sheet 31 is attached to the inner surface of top wall 12 while a similar sheet 32 is attached to the inner surface of back wall 16. Closing panels 17 and 19 have insulating sheets 34 and 35 attached to their inner surfaces. The size of sheets 34 and 35 is controlled so that there is no interference with walls 11 and 12 or the insulation thereon when the closure panels are closed. A plurality (2–8, generally 3 to 5) of shelves 36 are provided within container 10. These are held in position by spacer blocks 37. Shelves 36 are fabricated out of cardboard with its corrugation wave running from front to back, rather than side to side. The space between shelves is generally at least about 2 inches. Spaces 37 may be affixed to side walls 14 and 15 or may be held in place by vertical compression resulting from oversizing their vertical dimension slightly beyond the exact clearance. If the spacers 37 are affixed to walls 14 and 15 this enables shelves 36 to be removable. This is preferred. Shelves 36 can be sized so as to extend to insulating sheets 34 and 35 in this embodiment as the flanges on panels 17 and 19 do not cut across them. Depending upon the use to which container 10 is sought to be put, this can enable larger, higher edible materials to be stored or transported. In a preferred embodiment, the shelves 36 are left in place so that shelves 36 divide the interior of container 10 into a plurality of about 2 inch high subcompartments. This size is excellent for accommodating pizzas, hors d'oeuvre, and like prepared foods. The subcompartments increase the container's efficiency because cardboard is a good insulator and the subcompartments individually have a lower heat capacity and thus are less prone to bring about changes in the temperature of the contained foods. In the same sense, this embodiment, with its top and bottom hinged front covers offers the advantage that half of the subcompartments can be accessed without disturbing the remainder. This cuts down on heat changes as well.

Figure 2:
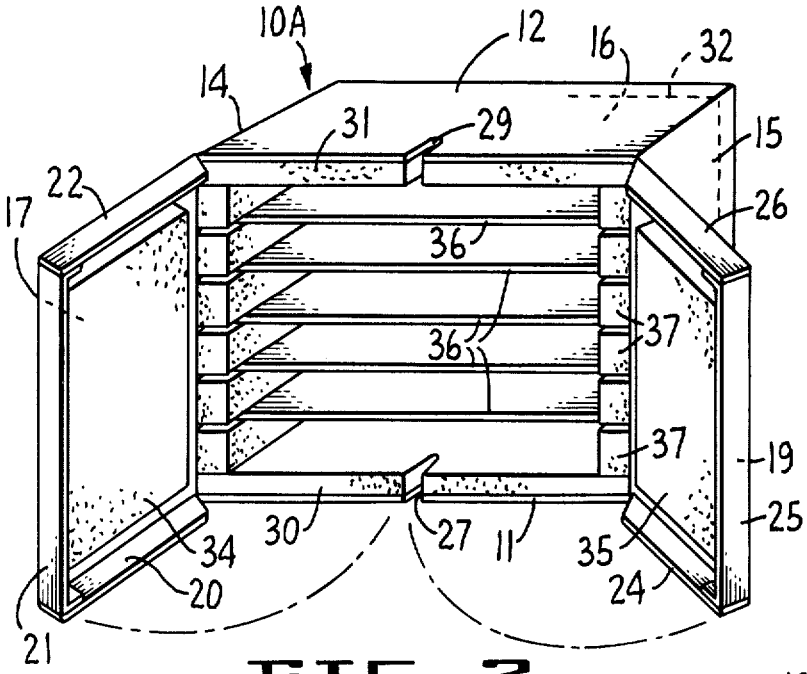
FIG. 2 is an isometric view of an alternative embodiment of the thermal retention container of the invention.

In FIG. 2, an alternative configuration of container (10A) is shown in which the closing panels open from side to side rather than up and down. This embodiment presents the same arrangement of walls 11, 12, 14, 15 and 16. Closing panels 17 and 19 are hinged from opposite sides 14 and 15, respectively. Notches 27 and 29 are present on walls 11 and 12, respectively, to accommodate and engage flanges 21 and 25 on the two closing panels. This configuration offers the feature that flanges 21 and 25 cut across the shelves. Accordingly, the shelves should be notched if it is intended that they be extended out to where they contact the insulation sheets on the closing panels.

Figure 3:
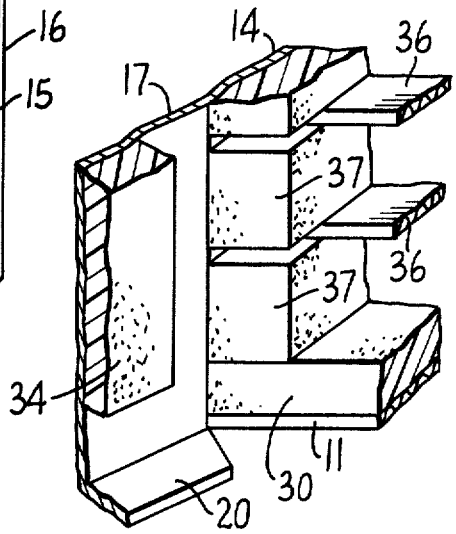
FIG. 3 is an expanded scale isometric view of one shelf and side wall construction of the container of FIG. 2.
Figure 4:
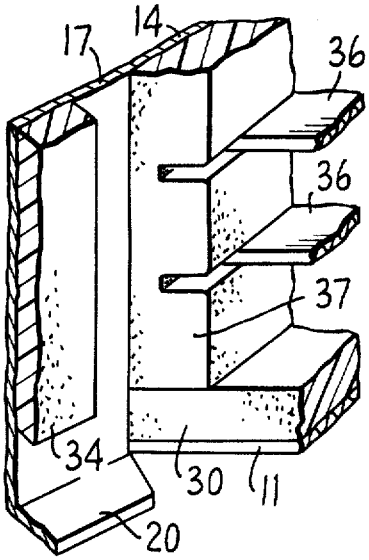
FIG. 4 is an expanded scale isometric view of an alternative shelf and side wall construction.

Turning now to FIG. 3, an expansion of FIG. 2 at the lower hinge joint between closing panel 17 and wall 14 is presented. In FIG. 3, bottom wall 11, front closure 17 and flange 20 are shown as are insulating panels 30 and 34. The relationship of spacer blocks 37 and shelves 36 is shown. As shown, shelves 36 are set back behind from the edge of bottom 11 and insulation sheet 30. This enables closing panels 17 and 19 to be closed without their flanges 21 and 25 interfering with these shelves. Alternatively, shelves 36 could be notched to accommodate flanges 21 and 25. FIG. 4 shows an alternative construction wherein spacer blocks 37 are part of a side wall insulation construction. In this embodiment, blocks 37 are part of a one-piece integral plastic foam casting that includes a side insulating sheet grooved to accept shelves 36. In this construction, like the embodiment wherein spacer blocks 37 are affixed to walls 14 and 15, shelves can be removed.

Figure 5:
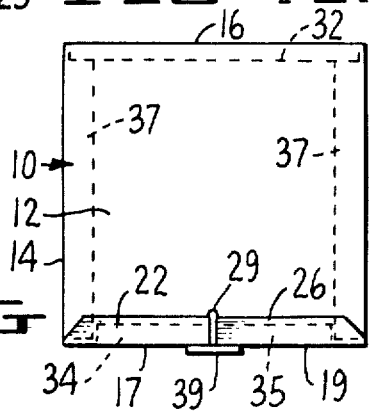
FIG. 5 is a top view of the container of FIG. 2 in closed position.

In FIG. 5, a simple top view of container 10A of the invention is provided. Walls 14, 15 and 16, top 12, and closing panels 17 and 19 are shown as are insulating panels 32, 34 and 35 as spacer blocks 37. This Figure shows panels 17 and 19 closed and depicts the engagement of their flanges into the notches in top 12. Closing means 39 is shown on panels 17 and 19.

The foregoing disclosure of specific embodiments is merely illustrative of the broad inventive concepts comprehended by my invention, which invention is as described by the following claims.

What is claimed is:

1. A disposable thermal retention container for edibles comprising:

(a) an exterior housing of cardboard having a bottom wall, opposite side walls and top and rear walls defining an open front shell, (b) two rectangular front closing panels hinged to the front edges of two opposite walls, said panels each having flanges perpendicular to their surface on their three nonhinged edges, the front edges of the remaining two walls having notches to admit and engage the flanges on the closing panels in their closed position, (c) flat plastic foam inner panels corresponding in size to and affixed to the inner surfaces of the bottom wall, top and rear walls and front closing panels, and (d) a plurality of removable cardboard shelves held in spaced alignment parallel to said bottom wall by a plurality of pairs of plastic foam spacing means located on the inner surfaces of the opposite side walls.

2. The container of claim 1 wherein the spacing means are individual blocks.

3. The container of claim 1 additionally comprising flat plastic foam inner panels corresponding in size to and positioned at the opposite side walls and having the spacing means integral therewith.

4. The container of claim 1 additionally comprising latching means for holding the front closing panels shut.

5. The container of claim 1 wherein said plastic foam is low density polystyrene foam.

6. A disposable insulated container adapted for storing and transporting a plurality of pizzas comprising:

(a) a rectangular exterior housing of cardboard having a bottom wall, opposite sidewalls and top and rear walls defining an open-front shell, (b) two rectangular front closing panels hinged to the front edges of two opposite walls, said panels each having flanges perpendicular to their surface on their three nonhinged edges, the front edges of the remaining two walls having notches to admit and engage the flanges on the closing panels on their closed position, (c) flat plastic foam inner panels of insulating thickness corresponding in size to and affixed to the inner surfaces of the bottom wall, top and rear walls and front closing panels, and (d) 2 to 8 removable cardboard shelves held in spaced alignment parallel to said bottom wall by a plurality of pairs of about 2 inch high plastic foam spacing means located at the inner surfaces of the opposite side walls.

7. The container of claim 6 wherein said closing panels are hinged to the front edges of the top and bottom walls.

* * * * *